US008070160B2

(12) United States Patent
Mali

(10) Patent No.: US 8,070,160 B2
(45) Date of Patent: Dec. 6, 2011

(54) PLAYING CARDS SHUFFLING AND DEALING MACHINE

(76) Inventor: Vasant Dattatraya Mali, Pune (IN)

( * ) Notice: Subject to any disclaimer, the term of this patent is extended or adjusted under 35 U.S.C. 154(b) by 0 days.

(21) Appl. No.: 12/445,970

(22) PCT Filed: Oct. 29, 2007

(86) PCT No.: PCT/IN2007/000515
§ 371 (c)(1),
(2), (4) Date: Apr. 17, 2009

(87) PCT Pub. No.: WO2008/062477
PCT Pub. Date: May 29, 2008

(65) Prior Publication Data

US 2010/0320684 A1 Dec. 23, 2010

(30) Foreign Application Priority Data

Oct. 30, 2006 (IN) ..... 1798/MUM/2006

(51) Int. Cl.
*A63F 1/14* (2006.01)
*A63F 1/12* (2006.01)

(52) U.S. Cl. ..... 273/149 R; 273/149 P

(58) Field of Classification Search ..... 273/149 R, 273/149 P
See application file for complete search history.

(56) References Cited

U.S. PATENT DOCUMENTS

| | | | | |
|---|---|---|---|---|
| 2,061,668 | A | 11/1936 | Nelson | |
| 4,033,590 | A * | 7/1977 | Pic | 273/149 R |
| 5,067,713 | A | 11/1991 | Soules | |
| 5,490,676 | A | 2/1996 | Rake | |
| 6,361,044 | B1 * | 3/2002 | Block et al. | 273/149 R |
| 6,651,985 | B2 | 11/2003 | Sines | |
| 7,029,009 | B2 | 4/2006 | Grauzer | |
| 2002/0063389 | A1 | 5/2002 | Breeding | |
| 2006/0157930 | A1 * | 7/2006 | Shai | 273/149 R |

* cited by examiner

*Primary Examiner* — Benjamin Layno
(74) *Attorney, Agent, or Firm* — Vangelis Economou; Economou IP Law

(57) ABSTRACT

The invention presents a methodology and device for distribution of playing cards. Automatic operation without manual intervention is its main theme. This eliminates the likely manipulations, monotony, errors associated with manual handling of playing cards. The device has provision of conventional automatic shuffling prior to distributing. Playing cards shuffled in more elaborate manner by other suitable devices also can be used on the invented device. There are many user friendly features of the invented device. These include compact size, portability, ease of operation and maintenance, adaptability to any card games. Optional operation of this device by a remote control enhances its utility Standard playing cards of Bridge or Poker size can be used with this device. The invented device is said to be useful to group of players in homes, club houses, casinos and at out-doors.

12 Claims, 9 Drawing Sheets

Standard Dealing up to 8 players
Schematic arrangement 6 players selected Cards dropped in pockets 1 to 6 only.

Dealing on a rotating disc.

Schematic arrangement

Dealing for Bridge players

Schematic arrangement

Circular dealing with extendable rotating arm

Schematic arrangement

PLAYING CARDS SHUFFLING AND DEALING MACHINE

CROSS-REFERENCE TO RELATED APPLICATIONS

This application claims priority to and the benefit of PCT Patent Application No. PCT/IN2007/000515, filed on Oct. 29, 2007(published as WO2008/062477), the PCT application itself relying for priority on Indian Patent Application No. 1798/MUM/2006, filed on 30 Oct. 2006, issued as Indian Patent No. 227,846, the entire contents of both applications being are incorporated herein by reference.

BACKGROUND OF THE INVENTION

1. Field of Invention

This invention relates to Automatic Shuffling and Dealing of Playing Cards in a variety of card games.

2. Background of Invention with Regard to the Drawback Associated with Known Art Card games like Rummy, Bridge, Poker and their numerous variations are played by a group of persons. In these games cards are shuffled and distributed, also popularly called as dealt, to each player in a pre-decided manner. The distribution of cards is done from a shuffled stack of one or more decks. Generally shuffling and distribution of cards is done manually by one of the players or by another person deployed for the purpose. There are some devices already available for automatic shuffling. The cards either shuffled manually or using the automatic machines are distributed manually to card players as per the rule of the game Some of the devices for automatic shuffling are patented mostly in United States of America. These automatic machines are used for shuffling of one or more decks of cards to form a stack of randomly shuffled cards. This shuffled stack of cards is transferred to a container popularly known as dealing shoe. The randomly shuffled cards are manually distributed to players with the help of dealing shoe . . . .

Recently patented automatic shuffling devices provide computerized random shuffling forming a single or multiple stacks of cards. The randomly shuffled cards from the single stack or the multiple stacks of cards are manually distributed to players with or without the help of dealing shoe. This practice is commonly followed in casinos for playing Poker.

Viewing and playing card games on-line on computer screen is also quite common. However there is no physical handling of cards.

For physical handling of cards in games like Bridge, Rummy there are no automatic devices in common use. In these games 13 or more cards are distributed to each player. Rummy is played by as many as 8-10 players. Thus about 130 or more cards are required to be distributed in every game.

Manual shuffling and distributing cards in large numbers is cumbersome, monotonous and error prone. Besides, manual distribution leaves room for manipulations and unfair practices.

OBJECT OF INVENTION

For smooth and pleasant play of card games the players expect to overcome the following deficiencies in existing practices:

1. Monotony and fatigue due to repeated manual actions.
2. Chances of errors in counting and distributing.
3. Separating sticky cards.
4. Chances of manipulations.
5. Loss of time in wasteful actions.

All existing devices provide random shuffling but no device provides automatic dispensing of cards. An automatic device to overcome the above deficiencies and incorporating the features as below is the object of this invention.

1. Simulation of process as done manually but carrying out automatically, without human interference.
2. Provision to use manually shuffled cards or cards shuffled by using any other device.
3. Provision of built in conventional automatic shuffling.
4. Facility to operate the machine from a remote control.
5. Adaptability to any popular card games.
6. Flexibility to use any patterns of dealing the cards.
7. Suitability for Poker or Bridge size cards.
8. Ease of operation and maintenance.
9. Portability, compactness, smart appearance.
10. Convenience of using in homes, club-houses, casinos or out doors.

SUMMARY OF INVENTION

The invented Playing cards shuffling and dealing machine is devised for automatic operation. It incorporates a conventional card shuffling arrangement, specially developed card dispensing mechanism, card sensing arrangement and collection of cards in separable, pocketed trays. The electronic control system offers flexibility to preprogram and select any combination of dispensing the cards. Dealing cards to any number of players, in desired sequence for any popular or special card games can be pre-programmed. By using the compact dispensing unit along with conventional handling devices any pattern of placing the cards can be formed to suit the convenience of the players. The device can be operated optionally from a remote control. The invented device is useful in homes, club houses, casinos, entertainment centers, fun-fairs and at picnic spots.

DETAILED DESCRIPTION OF THE PREFERRED EMBODIMENTS

Figure 1:
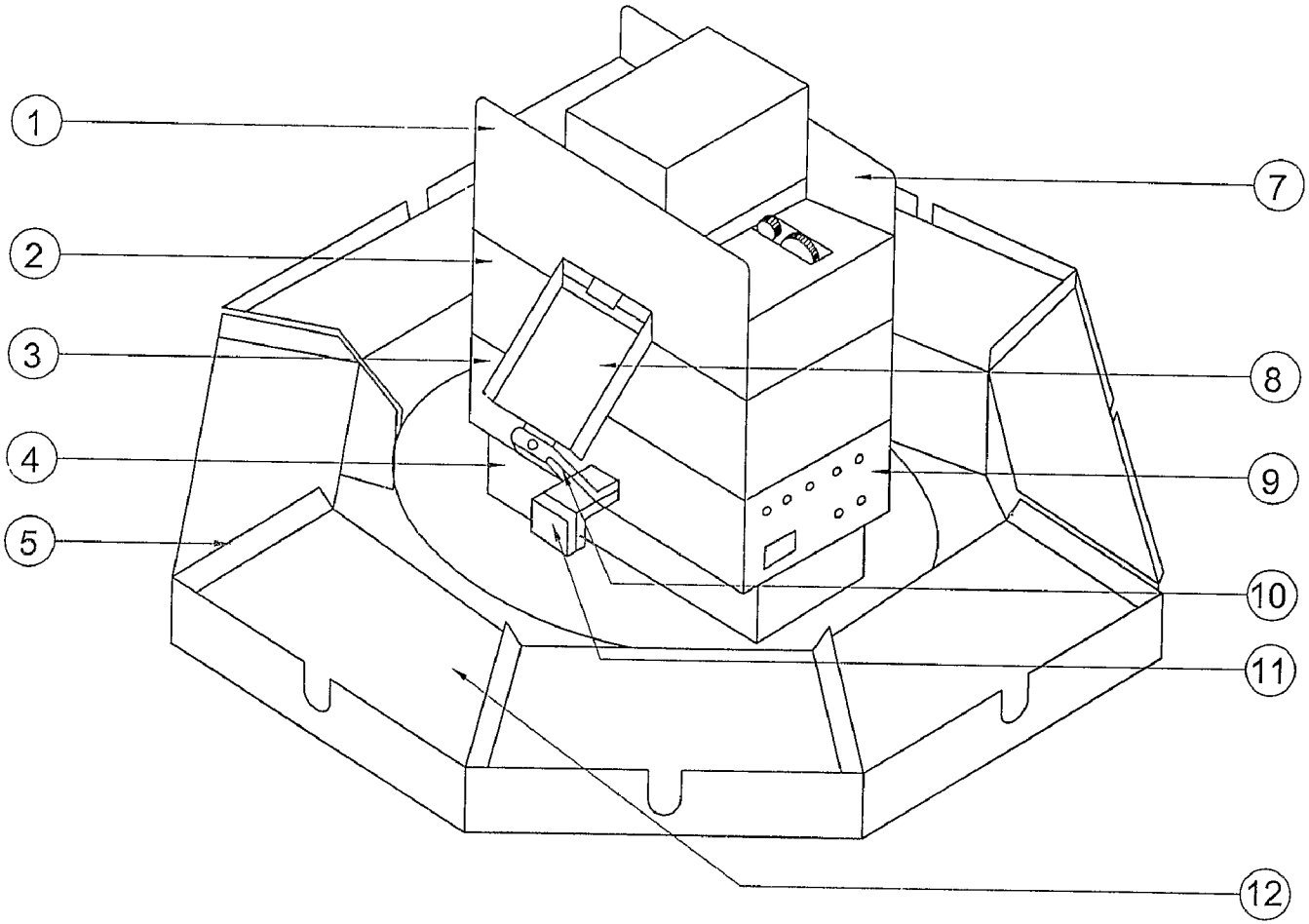
FIG. 1 is a perspective view of the inventive card shuffling and dealing device.
Figure 2:
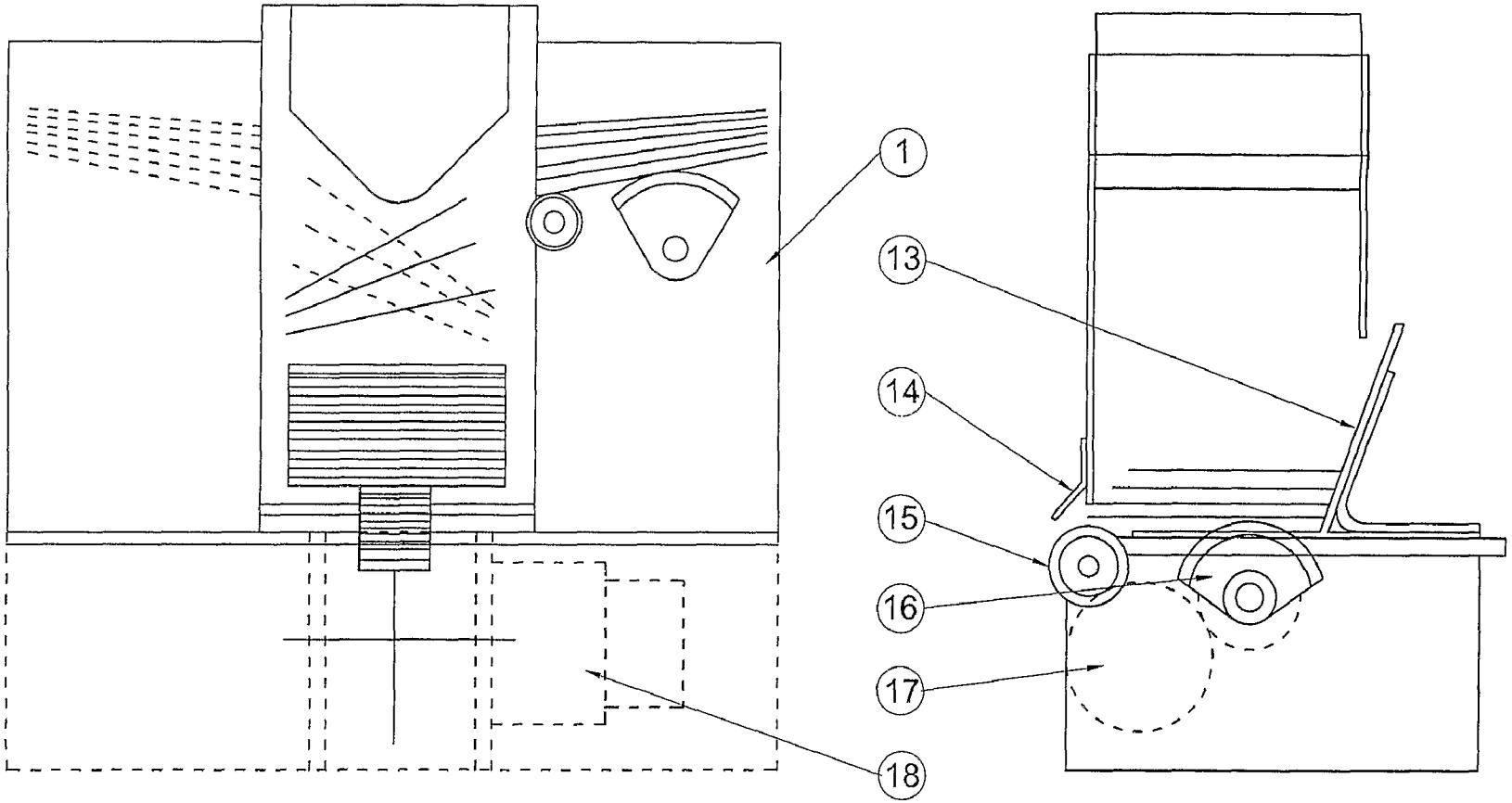
FIG. 2 illustrates partial cutaway front elevation and cross-section side views for showing the Cards Shuffling chamber.

The machine comprises a number of modules put together as shown in FIG. 1. The conventional Shuffling unit (1) is mounted at top. It has two pockets (7) on opposite sides. Two bunches of cards of approximately equal height are kept in the pockets for shuffling. The card separating and dispensing unit (2) is just below the shuffled stack of cards. FIG. 2 shows sectional view of shuffling chamber and card pulling mechanism. The cards shuffled by built-in conventional shuffler fall into the central chamber forming a tapered stack. Optionally shuffled cards by any other device can be loaded into the chamber with the help of card holder ((13). An electric motor, through gearing, actuates rotation of a segment having a friction surface coming in contact with the bottom card tangentially. The segment when at highest point during rotation lifts the stack momentarily and carries the bottom card along with it towards a rotating roller (15).

The card further passes over the rotating roller (15) and strikes an inclined stopper (14). The stopper is positioned above the roller and offers resistance to the card and pushes its edge against the roller. The bottom card is driven out from the gap between roller and stopper. The card is driven by the roller further and falls on the conveying chute (8). The inclined chute carries the card by gravity and falls into the pocket which is in front of the chute. Before falling into the pocket the card is sensed by the sensor (10). The rotation of roller is then stopped and the next bottommost card is prevented from moving further. The signal generated on sensing the card initiates next action of moving the dealing unit to next position. The cycle of pushing out bottommost card and dropping it into the pocket at pre-decided position keeps repeating till completion of selected program.

The standard configuration of the machine is such that the aggregate of units (1), (2), (3) and unit (4) rotate around a vertical axis. The unit (4) is attached to the bottom of unit (3) which houses a drive motor (22) with gearing for rotation. The aggregate of units (1), (2), (3) and (4) is supported in radial and axial bearings. The bearing housing is attached to the stationary base (19) having a round top plate. There are two semicircular detachable trays (12) having 4 pockets on each. These trays are placed around the machine base. The rotating unit rotates in steps of 45 degrees and stops when the card dropping chute is above one of the 8 pockets. One card is dropped at required pocket every time as per selected program.

Figure 3:
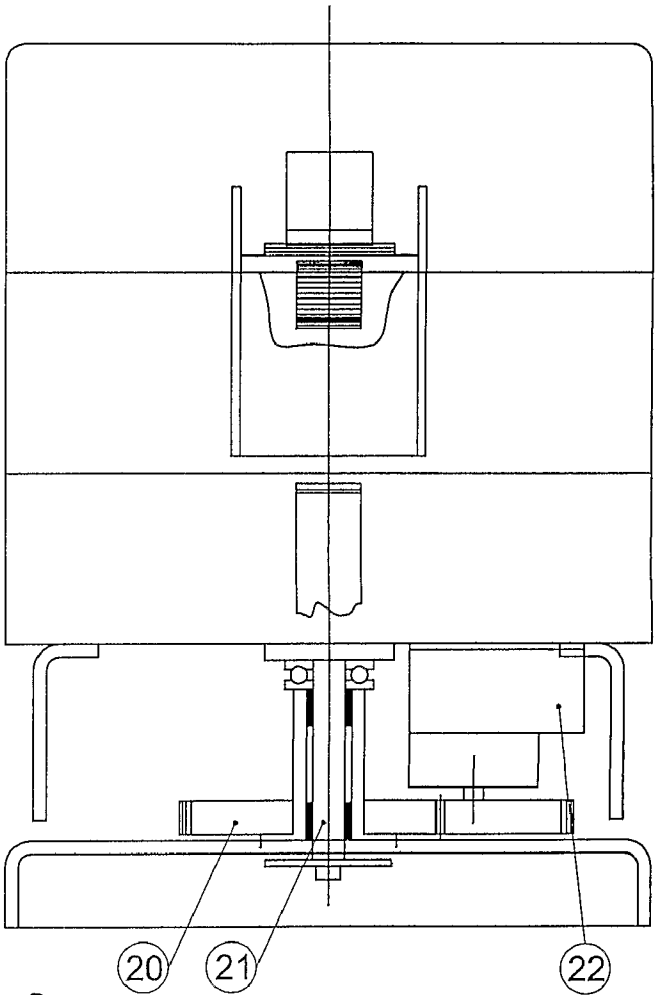
FIG. 3 illustrates front elevation and partial cutaway side views showing the card pulling arrangement.
Figure 3:
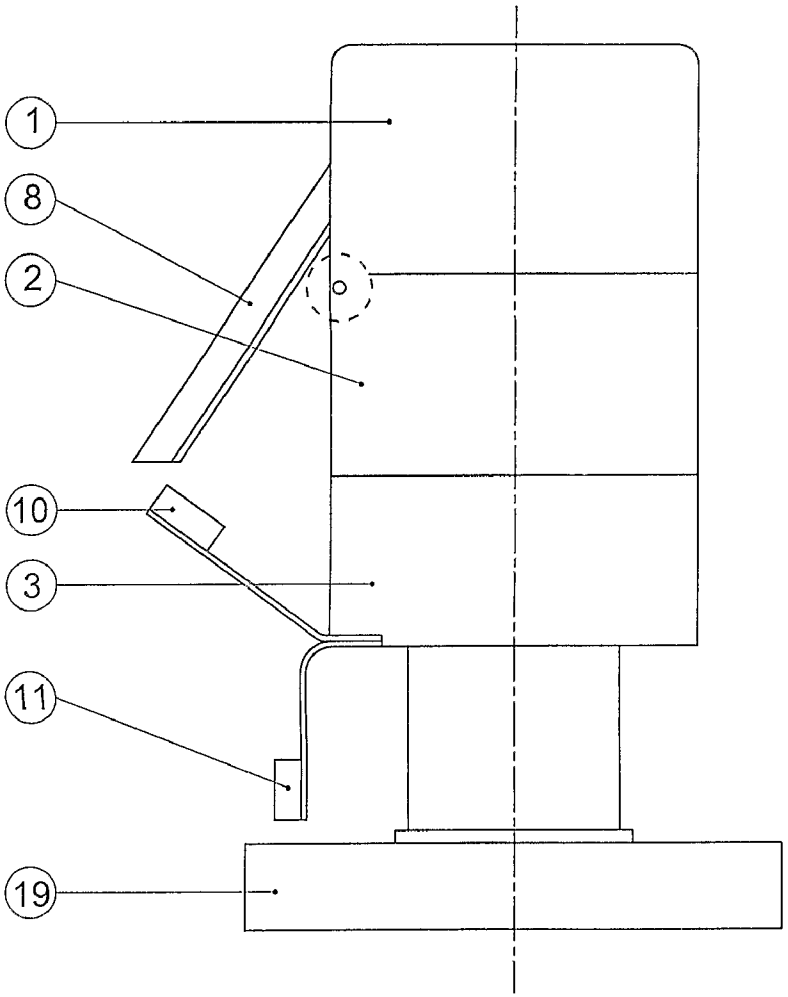

FIG. 3 shows side view and sectional view of the drive arrangement for rotating the unit. The shaft (21) connected to the assembly of modules (1), (2), (3) is supported in radial and thrust bearings. Geared motor attached to module (3) engages its pinion to gear (22) secured to the bearing housing fixed to the base (19). Cover (4) encloses the motor and gears.

Figure 4:
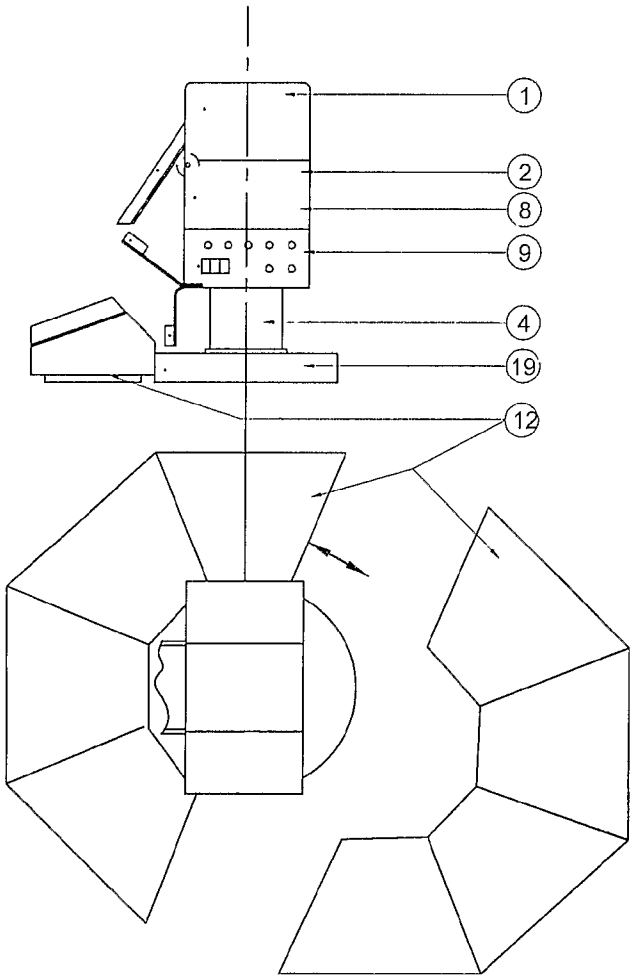
FIG. 4 illustrates broken out top plan and side views showing the control panel and detachable trays according to an embodiment of the invention.

FIG. 4 shows the detachable trays (12), one of them shown moved away. These trays can be placed in any angular orientation with respect to the central unit. Initially the trays are kept to align one of the pockets directly below the chute so that the card falls into the pockets evenly.

The circuitry comprises a programmable micro controller and related components. The control actuators comprising switches for power supply on/off, program selection, shuffling, start/pause/restart are placed on the side cover of unit (3).

The dealing unit alone, with or without conventional shuffling unit, can be arranged in many configurations. Some of the convenient arrangements are described below and shown in the drawings.

EXAMPLES OF STANDARD AND OPTIONAL DEALING CONFIGURATIONS

Figure 5:
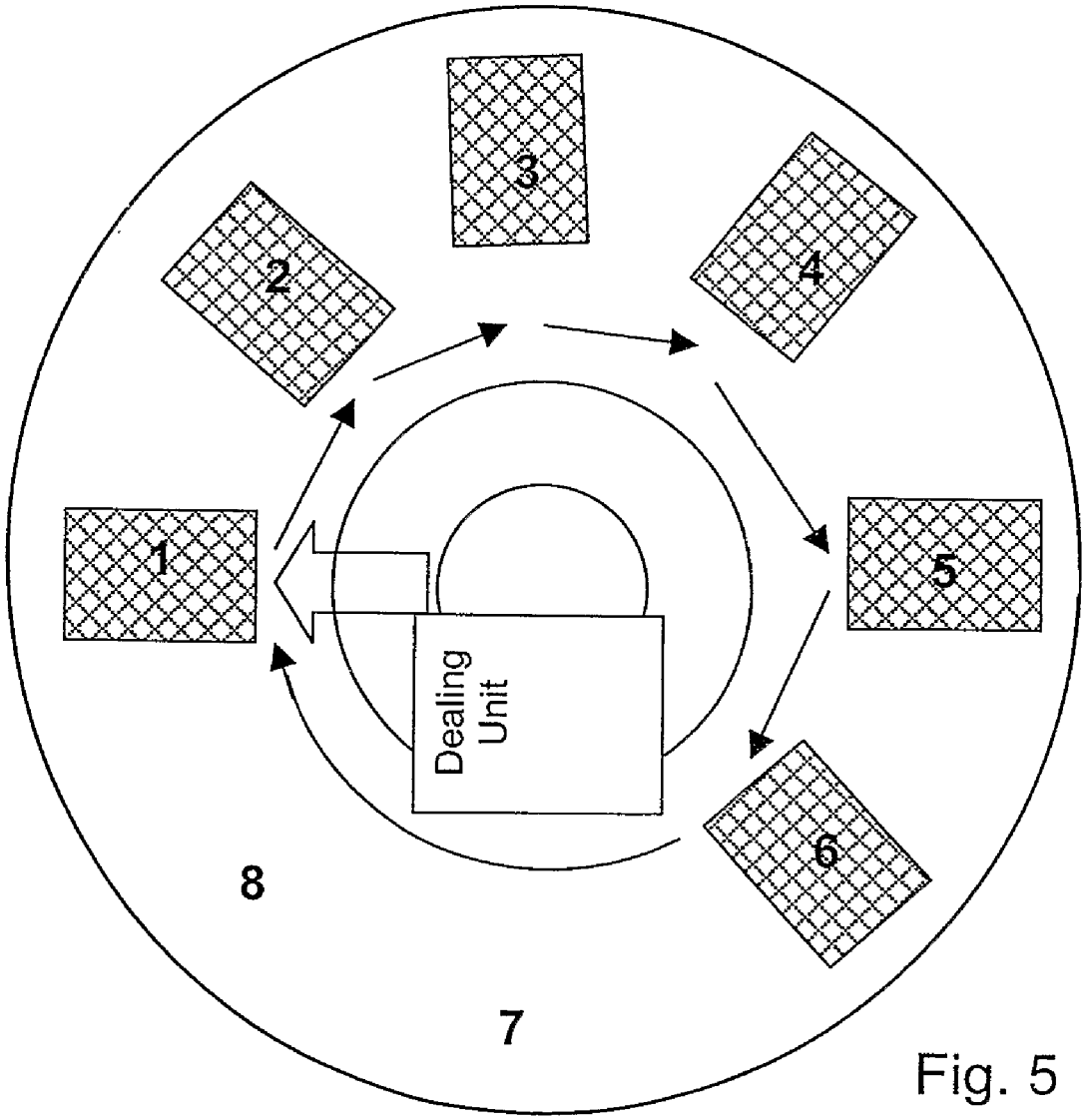
FIG. 5 shows in a schematic drawing a standard dealing pattern from a central dealing unit.

FIG. 5 shows standard dealing up to 8 players. When less than 8 players are selected, the cards are dealt into only required number pockets skipping the extra pockets. The illustration shows 6 players selected, so cards at positions 7 & 8 are not dropped.

Figure 6:
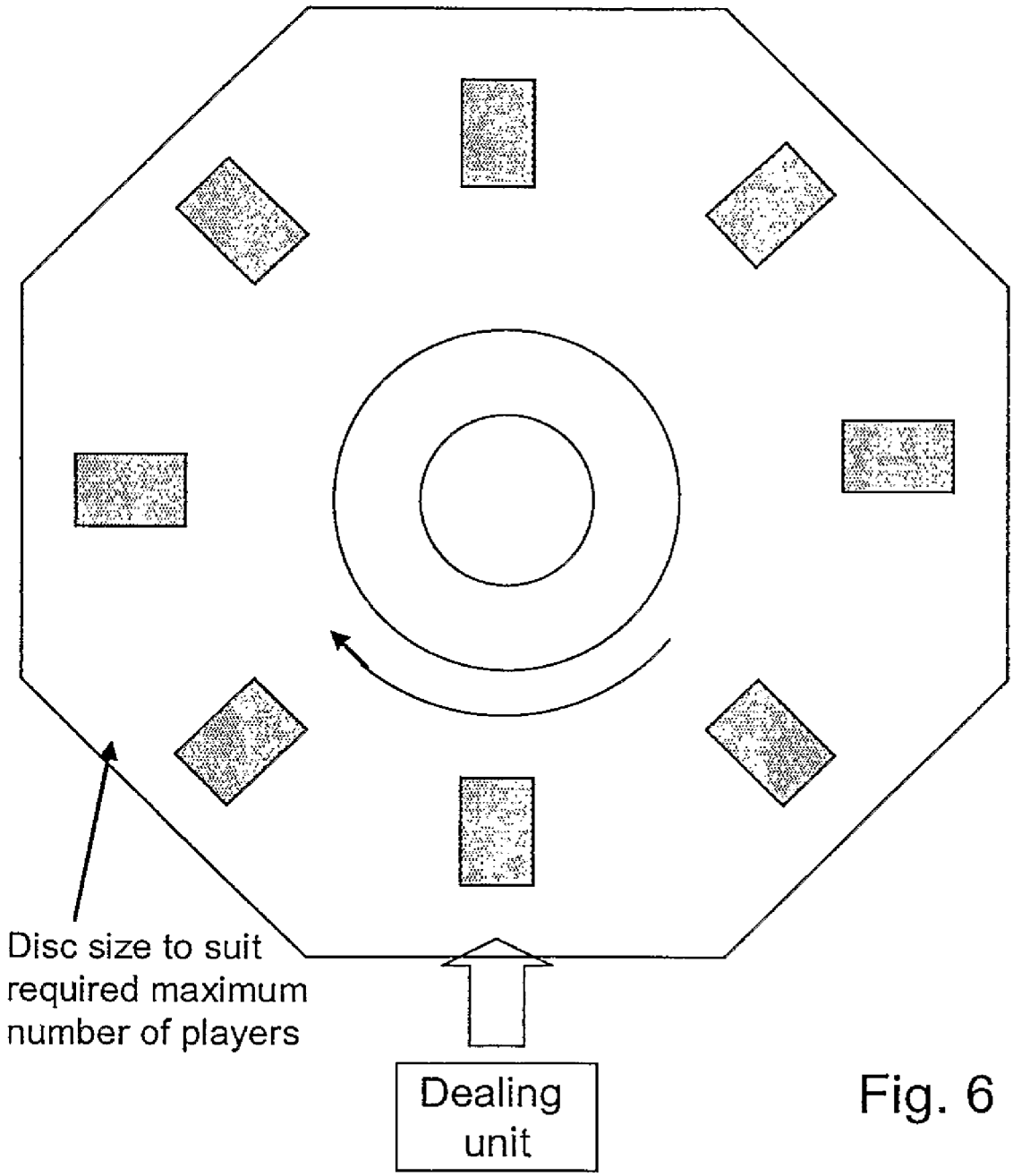
FIG. 6 shows in a schematic drawing another embodiment in which dealing is from a rotating disc.

FIG. 6 shows optional dealing from stationary dealing unit to a rotating disc. The rotating disc size and number of players is not limited. The disc rotation start/stop/direction and card dispensing sequence can be programmed as desired.

Figure 7:
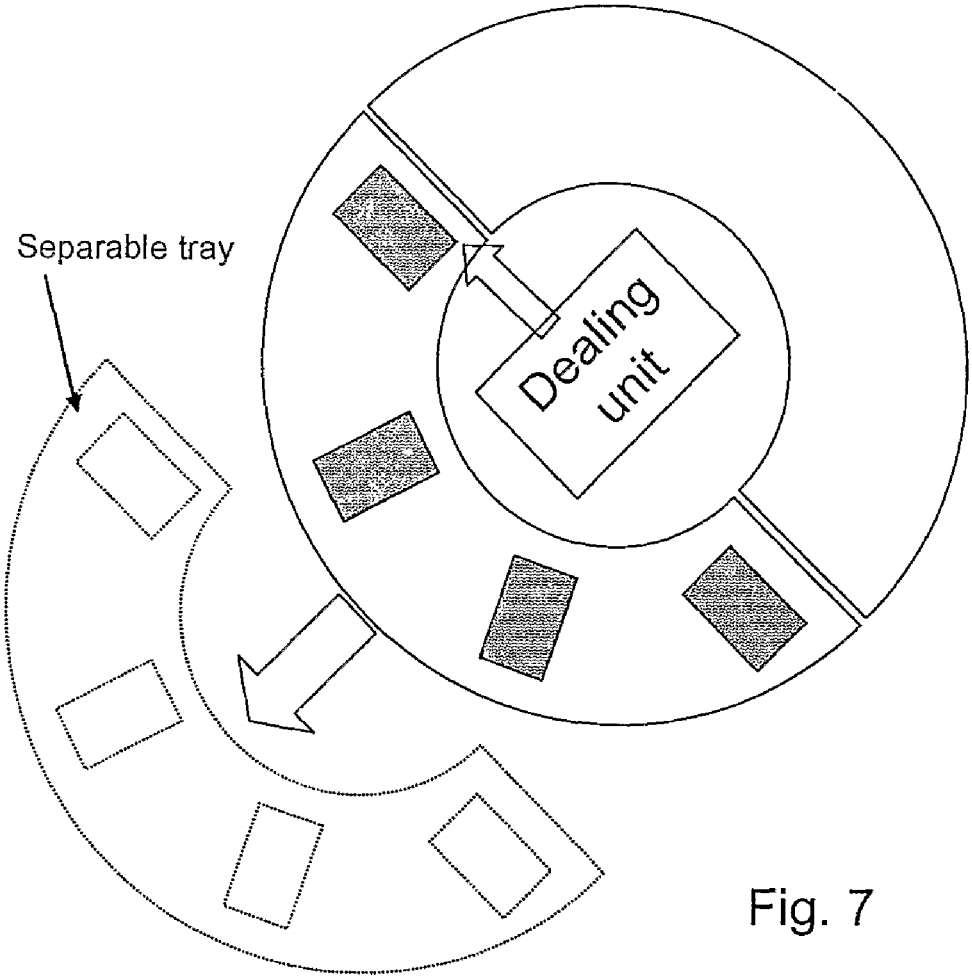
FIG. 7 shows in a schematic drawing another embodiment in which the configuration is provided for dealing Bridge in detachable trays.

FIG. 7 shows dealing for bridge players. Cards are dropped into 4 pockets of one tray. Two or more decks of 52 cards are used in circulation. Initially 2 decks are loaded. After dealing 52 cards from one deck the filled tray is taken out and replaced with an empty tray. Next deck of cards from previously played game is added. The machine restarted for next dealing cycle. Thus the dealt sets will be ready for next game by the same players or by another group of players.

Figure 8:
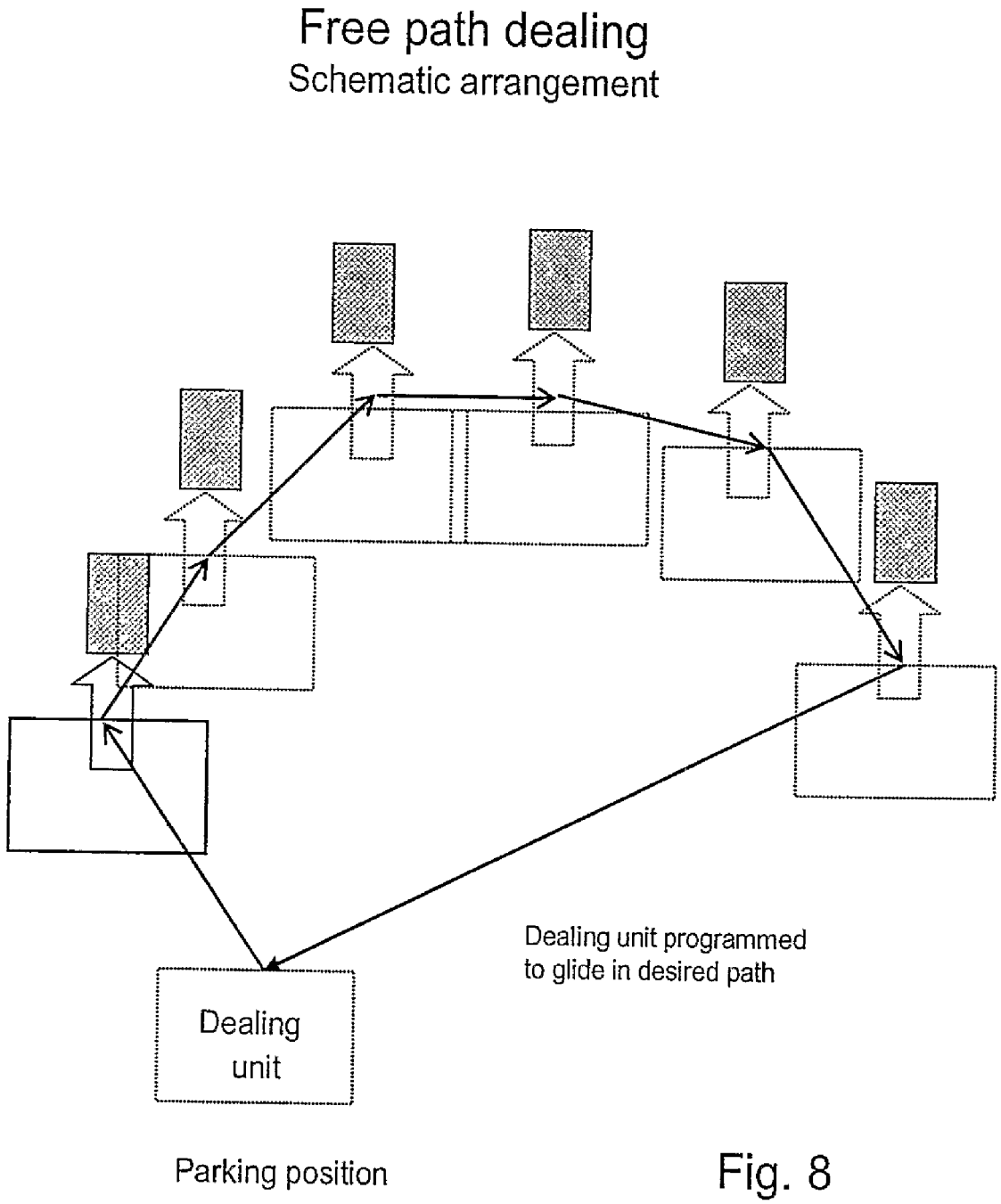
FIG. 8 shows in a schematic drawing another embodiment in which the configuration is provided for free path dealing on a large card table.

FIG. 8 shows free path dealing arrangement. The dealing unit is kept on a self propelling base which can move on table surface in any direction and distance. By interlinking the movement of dealing unit and card dispensing cycle any desired path, any number of card dropping positions can be programmed. The dealing can be assigned a parking position where loading/unloading of cards can be done. Pre-shuffled stack of cards can be transferred to the dealing unit at this position, either manually or automatically.

Figure 9:
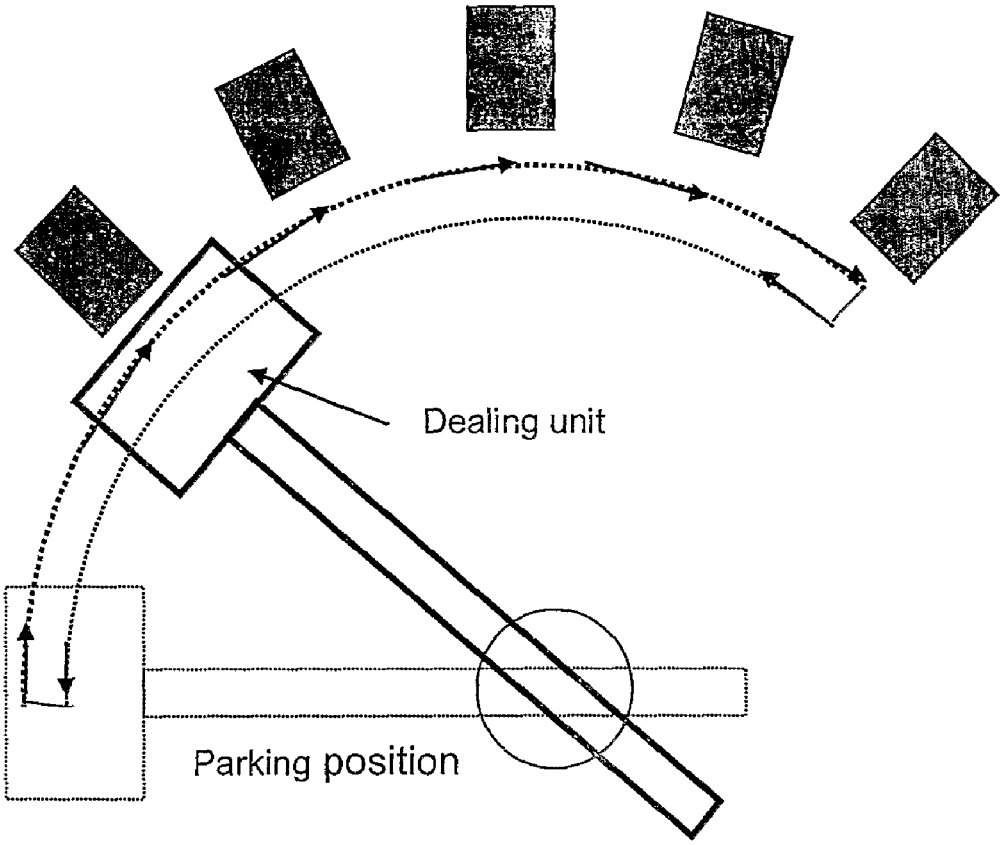
FIG. 9 shows in a schematic drawing another embodiment in which the configuration is provided for circular dealing by using an extendable rotating arm.

FIG. 9 shows a dealing pattern on a large segment using an extendable arm pivoted to one side or corner of the table. The arm carries the dealing unit which along with the arm moves on circular path. The card dropping positions and parking position can be selected and operated automatically interlinking the card dispensing cycle.

Alternatively the arm movement can be done manually simply by pushing or pulling the handle connected to the arm. End stopper can be provided to restrict unnecessary movements. Intermediate positions can be visually monitored to drop the cards just in front of the players and/or latched at required positions. A push button near the handle to be used to initiate automatic dispensing of cards.

Operation of the Card Shuffling and Dealing Machine.

Normal operation of the machine requires only touching the cycle start button once. Cycle on is indicated by an audio beep and green LED switched on.

Following preparations are required to set the machine initially.

1. Switch on power supply, Red LED switched ON.
2. Set thumb wheel switch to select three digit program codes. Unknown program code gives error signal by multiple short beeps and blinking yellow LED.

The machine has a pause switch to stop and restart the cycle if required. When an abnormal card gets stuck or quantity of cards is insufficient the machine automatically goes in pause mode giving audio and visual alarm indicating error as above.

A switch is provided to shuffle the cards conventionally. Shuffling can be done any number of times before starting the dealing cycle.

A card holder is provided to take out left over cards. Pre-shuffled cards can also be inserted into the machine with the help of the card holder Cycle start, pause and restart can be optionally done from a remote control.

Other Features.

The playing cards shuffling and dealing machine has following user friendly features.

1. Compact overall size, portability, smart appearance.
2. Can accept standard bridge or poker size cards of conventional materials, textures and back faces of any design, color or pattern.
3. Convenient to pre-program any regular or unconventional card playing games with quick change over.
4. Provided with easily replaceable or rechargeable standard batteries.
5. Ease of operation and maintenance.

The invention claimed is:

1. A playing cards shuffling and dealing device for automatic rotational distribution of playing cards enabling operation of preselected features, comprising an electro-mechanical card pulling mechanism, an arrangement for sensing the pulled out cards, a card dispensing unit, an arrangement for sensing the rotational position of the card dispensing unit, an arrangement for collecting groups of pulled out cards in a plurality of lower pockets, a mechanism for automatic movement of the card dispensing unit to predetermined rotational positions disposed adjacent at least one of the plurality of lower pockets, electric and electronic circuitry to pre-program and carry out automatic shuffling, dealing and distribution of playing cards, and a facility for shuffling as in a conventional manner or using a pre-shuffled stack of cards.

2. The device claimed in claim 1 wherein the cards are pulled out one by one from the bottom of a stack of cards by a mechanism which comprises a roller and a segment driven by an electric motor through gear trains, and further includes an inclined stopper above the roller, a chute to carry the card, and a sensor to sense a card face while the card is dropping into one of the lower pockets.

3. The device claimed in claim 1 wherein the one of the lower pockets supports the shuffled cards, and further includes an inclined face against which the shuffled cards are aligned to form a tapered stack to facilitate pulling out cards one by one.

4. The device claimed in claim 1 wherein the arrangement for collection of groups of pulled out cards further comprises detachable trays that are separable from the shuffling and dealing device, and each tray has one of a multiple of pockets, each with an inclined face for resting the cards, and each tray has slots at a front of each pocket.

5. The device claimed in claim 4 dealing patterns described as Dealing on a rotating Disc, Dealing for Bridge in the detachable trays, free path dealing on a large table, or Circular Dealing by means of an extendable rotating arm attached to the card dispensing unit.

6. The device claimed in claim 1 further including a conventional shuffling unit modified to be accommodated into the shuffling and dealing device such that the shuffled cards fall directly on the arrangement for collection of cards.

7. The device claimed in claim 1 wherein the arrangement for collection of groups of pulled out cards further includes a card holder.

8. The device claimed in claim 1 further being mounted on a rotating disc, the rotating disc being configured to rotate the dealing device in a circle to deal cards to players positioned around a card table.

9. The device claimed in claim 1 further including an extendable arm connected at one end to a rotation unit, the rotation unit being configured to rotate the dealing device in a semicircular path around the periphery of a card table.

10. The device claimed in claim 1 further including means for free dealing cards to preselected areas path around a card table.

11. A playing cards shuffling and dealing device for automatic distribution of playing cards from a stack of cards in a card holder comprising:

an electro-mechanical card pulling mechanism, an arrangement for sensing the pulled out cards, an arrangement for sensing the position of a card dispensing unit, an arrangement for collection of groups of pulled out cards in a plurality of lower pockets, an arrangement for automatic movement of the card dispensing unit to predetermined positions disposed adjacent at least one of the plurality of lower pockets, electric and electronic circuitry to pre-program and to carry out automatic shuffling, dealing and distribution of playing cards, and a facility for shuffling as in a conventional manner or using a pre-shuffled stack of cards, the cards being pulled out one by one from the bottom of a stack of cards, wherein the electro-mechanical card pulling mechanism further comprises a roller and a segment driven by an electric motor through gear, has an inclined stopper above the roller, wherein the card distribution device has a chute to carry the pulled out card to a predetermined position in one of the plurality of lower pockets, wherein the arrangement for sensing the pulled out cards is provided with a sensor to sense a card face while dropping into one of the plurality of lower pockets; and wherein the card holder supports the shuffled cards and has an inclined face against which the shuffled cards are aligned to form a tapered stack to facilitate pulling out cards one by one.

12. The playing cards shuffling and dealing device according to claim 11 wherein the arrangement for collection of groups of pulled out cards is separable from the shuffling and dealing device, has multiple pockets with inclined faces for resting the cards and has slots at a front of each pocket.

* * * * *